US006206567B1

(12) United States Patent
Cyr

(10) Patent No.: US 6,206,567 B1
(45) Date of Patent: Mar. 27, 2001

(54) CONTAINER HAVING DUAL OPENINGS FOR FACILITATING RAPID ACCESS TO THE INTERIOR OF THE CONTAINER

(75) Inventor: Ryan Cyr, Hidden Hills, CA (US)

(73) Assignee: Tamrac, Inc., Chatsworth, CA (US)

( * ) Notice: Subject to any disclaimer, the term of this patent is extended or adjusted under 35 U.S.C. 154(b) by 0 days.

(21) Appl. No.: 09/532,036

(22) Filed: Mar. 21, 2000

(51) Int. Cl.[7] ..... B65D 33/06; B65D 33/25; B65D 33/24

(52) U.S. Cl. ..... 383/29; 190/903; 383/29; 383/86; 383/97

(58) Field of Search ..... 383/29, 86, 97; 190/119, 903

(56) References Cited

U.S. PATENT DOCUMENTS 4,842,032 * 6/1989 Mastronardo ..... 190/903
4,961,522 * 10/1990 Weber ..... 190/903
5,297,870 * 3/1994 Weldon ..... 383/97
5,413,199 * 5/1995 Clement ..... 190/903
5,490,396 * 2/1996 Morris ..... 190/903
5,660,476 * 8/1997 DeCoster ..... 383/29
5,931,120 8/1999 Burns et al. .

* cited by examiner

*Primary Examiner*—Stephen P. Garbe
(74) *Attorney, Agent, or Firm*—Thomas I. Rozsa; Tony D. Chen; Jerry Fong

(57) ABSTRACT

A container having dual openings for facilitating rapid access to the interior of the container to remove articles from the container which includes two ends, two sides and a base. A side closure flap is attached to one of the two sides and forms a top when the flap is in a closed position for covering the top opening of the container. The side closure flap can be opened by flipping over the flap to gain access to the interior of the container. The top of the container has a full length double zipper which facilitates access to the interior of the container from the top instead of flipping over the side closure flap.

39 Claims, 2 Drawing Sheets

FIG.3
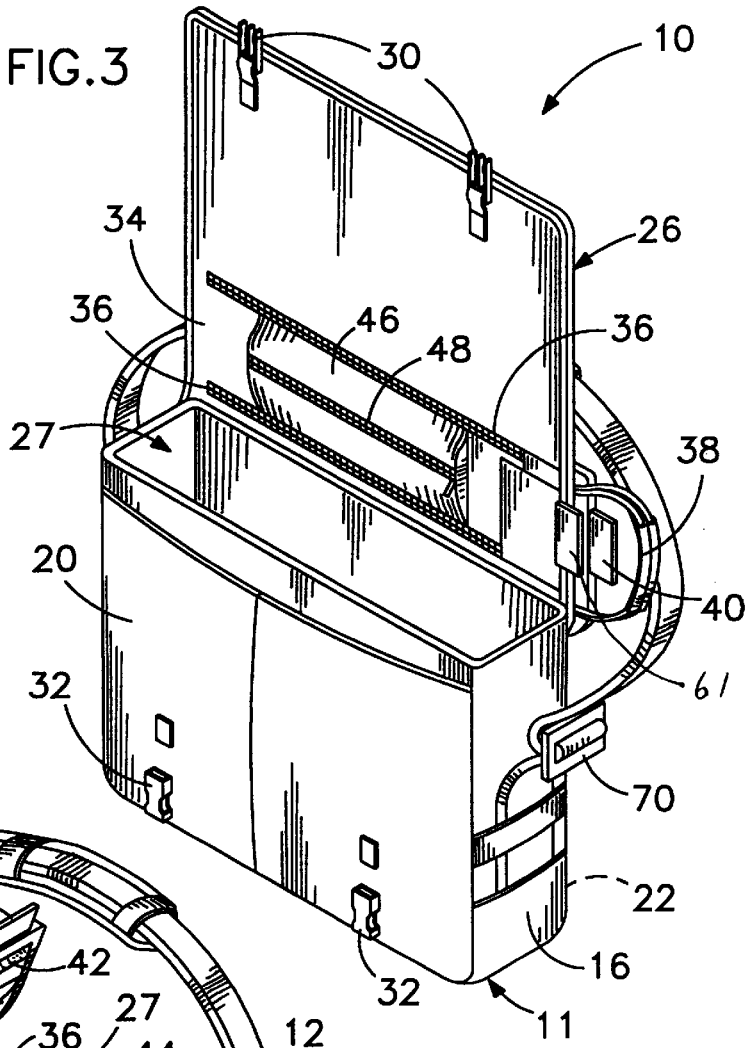
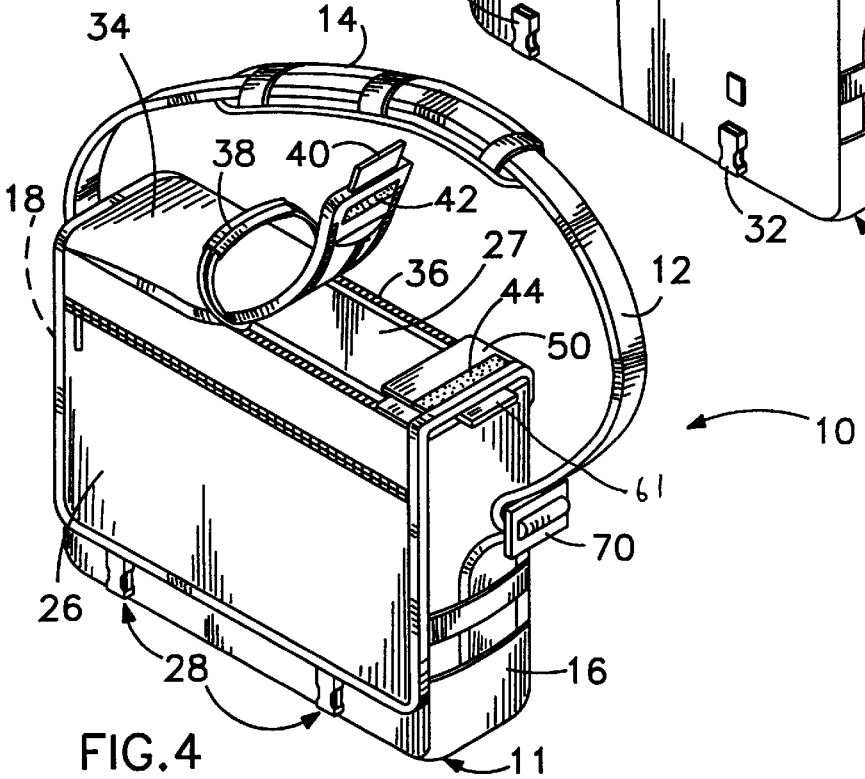
FIG.4

CONTAINER HAVING DUAL OPENINGS FOR FACILITATING RAPID ACCESS TO THE INTERIOR OF THE CONTAINER

BACKGROUND OF THE INVENTION

1. Field of the Invention

The present invention relates to the field of bags. More particularly, the present invention relates to the field of containers or the like having dual openings for facilitating rapid access to the interior of the container to remove articles such as laptop computers, computer accessories, cameras, camera equipment and other like articles retained in the container.

2. Description of the Prior Art

Generally, laptop computers, computer accessories, cameras, camera equipment and other like articles are usually stored in containers when not in use. Part of the problem which the present invention addresses is that when an individual wants to use the article retained in the container, the article is usually removed from the container by opening a standard side flap to access the interior of the container to remove the article of use. This is unsatisfactory because it is time consuming.

One prior art patent of which the present inventor is aware is U.S. Pat. No. 5,931,120 issued to Bums et al. on Aug. 3, 1999. The patent discloses a pet carrier for use in transporting pets within the passenger compartments of an aircraft and includes selectively closeable windows formed from mesh fabric, a fully operable end, a fully openable side for providing access to the interior of the pet carrier, an access port in the top having a full length double zipper closure and a rotatable locking member for securing the access port in the closed position.

It is desirable to provide a container which provides the user with the capability of rapidly accessing the interior of the container to remove articles such as laptop computers, computer accessories, cameras, camera equipment and other like articles retained in the container. It is also desirable to provide a container which has a conventional opening by opening a side closure flap and further has a top access which can be opened into the interior of the container for facilitating rapid access to the interior of the container to remove articles such as laptop computers, computer accessories, cameras, camera equipment and other like articles retained in the container.

SUMMARY OF THE INVENTION

The present invention is a novel container having dual openings for facilitating rapid access to the interior of the container to remove articles such as laptop computers, computer accessories, cameras, camera equipment and other like articles retained in the container.

The container comprises two end walls, two sidewalls and a base. A side closure flap is connected to one of the two sidewalls and forms a top for covering the top opening of the container. The side closure flap can be opened to access the interior of the container. The top is provided with a full length double zipper which facilitates insertion and removal of articles such as the laptop computers, computer accessories, cameras, camera equipment and other like articles from the top instead of the side closure flap.

It is an object of the present invention to provide a container which provides the user with the capability of rapidly removing articles such as the laptop computers, computer accessories, cameras, camera equipment and other like articles from the container.

It is also an object of the present invention to provide a container which includes a side closure flap integrally formed with a top, wherein the side closure flap can be flipped over to open the top to gain access to the interior of the container.

It is an additional object of the present invention to provide a container which includes a top with a full length double zipper for facilitating rapid access to the interior of the container without flipping over a side closure flap.

It is a further object of the present invention that the container includes bags, cases, briefcases or the like.

It is still further object of the present invention to provide a strap for carrying the container one's shoulder so that the user can access the interior of the container by unzipping double zipper while still carrying the container over the user's shoulder.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is a view similar to FIG. 1 illustrating a first opening of the container for accessing the interior of the container; and FIG. 4 is a view similar to FIG. 1 illustrating a second opening of the container for facilitating rapid access to the interior of the container.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
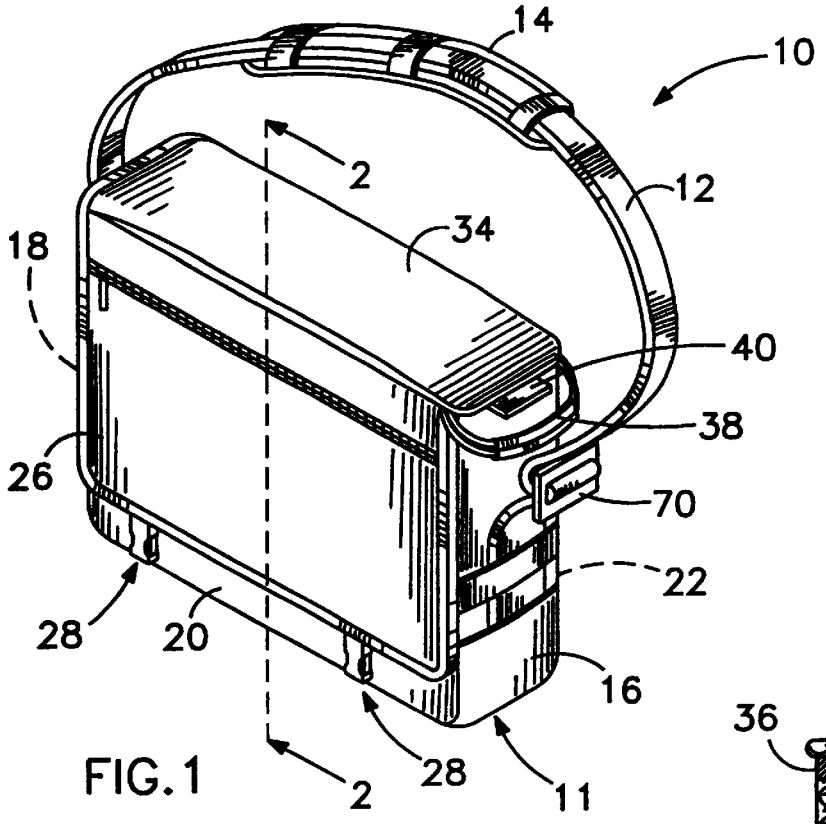
FIG. 1 is a front perspective view of the present invention container having dual openings for facilitating rapid access to the interior of the container.

Referring to FIG. 1, there is shown at 10 the present invention container which comprises a normally closed container 11 having a rectangular cross-section both as to its width and as to its length, it being understood that other cross-sectional configurations may be used in the practice of the invention, if desired. The container may include bags, cases, briefcases or the like. The container 10 may be constructed from Cordura® nylon material, a cotton duck material or any suitable material that can readily be sewn for convenience in manufacturing. However, it will be understood that other materials may be utilized in the construction of the container 10.

Figure 2:
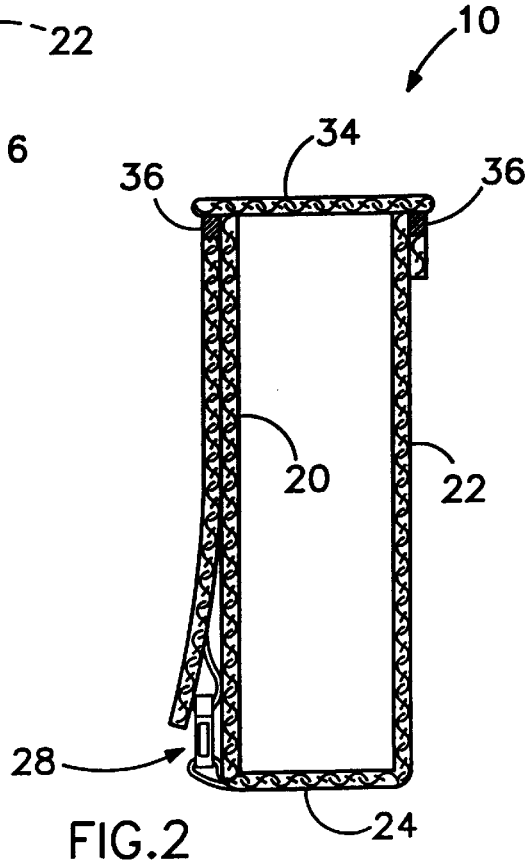
FIG. 2 is a cross-sectional view taken along line 2—2 of FIG. 1.

Referring to FIGS. 1 and 2, the container 10 is generally a substantially rectangular shaped structure, but it may be a square, oval, round or any other shape if desired. The container 10 includes a base 24, two end walls 16 and 18, and two sidewalls 20 and 22. The end walls 16 nd 18 are respectively connected at their adjacent edges to the adjacent edges of the side walls 20 and 22. The walls 16, 18, 20 and 22 extend upwardly from the base 24 to form a body 11 with a top opening 27 (see FIG. 3). The side walls 20 and 22 are much wider than the end walls 16 and 18, but this may be modified if desired. The container 10 may have auxiliary pockets attached on each end wall for storing certain types of articles, and there may also be side auxiliary pockets attached to each sidewall for storing other articles. These auxiliary pockets are fitted in the customary manner by being sewn on and which may be closed or opened, for instance by Velcro® fasteners, zipper fasteners etc. These auxiliary pockets are conventional in the art, and the description thereof will not be discussed.

Referring to FIGS. 1, 2 and 3, there is provided a side closure flap 26 which may be secured in the closed position by two locking fasteners 28. One of the longitudinal edges of the side closure flap 26 is attached to the exterior surface of the sidewall 22 and located adjacent to the upper longitudinal edge of the sidewall 22 and forms a top 34 which is positioned to span over and close the top opening 27 to the interior of the body 11 of the container 10.

Referring to FIGS. 1, 2, 3 and 4, the top 34 is provided with a full length double zipper construction 36 which facilitates rapid access to the interior container 10. A handle strap 38 is connected to the double zipper means 36 for simultaneously opening or closing the double zipper means 36. A first hand tab 40 is further provided at one end of the top 34. A second hand tab 61 is also provided on a small portion 50 which remains as part of the top when the rest of the top 34 is opened (see FIG. 4). A user can hold the first hand tab 40 with one hand and hold the second hand tab 61 with the other hand and pull apart the top 34 from the body 11 of the container 10 to access the interior of the body 11. There is also a closure fastener for securing the top 34 in the closed positioned. The closure fastener includes a male type hook member 42 and a complementary female type loop member 44. These hook and loop members 42 and 44 are Velcro® fasteners. The male type hook member 42 is attached to the interior surface of the top 34 while the female type loop member 44 is attached to the small portion 50 (see FIG. 4). It will be appreciated that the male and female hook and loop fasteners can be reversed with the female loop fastener attached to the top 34 and the male hook fastener attached to the small portion 50.

Referring to FIG. 3, there is also provided a pouch 46 which is centrally located on the interior surface of the top 34. The pouch 46 is opened and closed by a zipper member 48.

Referring to FIGS. 1, 3 and 4, the container 10 may be provided with a conventional shoulder strap 12 which is joined together at end walls 16 and 18 of the bag 10 by a buckle 70 (only one is shown). The shoulder strap 12 is adjustable in the lengthwise direction and further has an adjustable shoulder pad 14 which is slidably installed on the strap 12 for providing a cushion on the shoulder of a user.

One of the unique features of the present invention container 10 is that the side closure flap 26 is secured in the closed positioned by locking fasteners 28 and mating closure members 30 and further forms the top 34 for the body 11 of the container 10. Another unique feature of the container 10 is that the top 34 can be opened by unzipping the double zipper means 36 to open the top 34 to rapid access the interior of the body 11 of the container 10 so that articles such as laptop computers, computer accessories, cameras, camera equipment and other like articles are easily removed from the container 10. Therefore, the container 10 does not have to be opened in the conventional manner by opening the closure flap 26, but it can be opened by unzipping the double zipper means 36 to gain access to the interior of the container 10 so that the articles contained in the container can be removed through the top opening 27 ofthe container 10.

In addition, the entire container 10 can be carried on the user's shoulder by means of strap 12 and when the user is hurrying to a location, the user can open the container 10 by pulling up on hand tab 40 and then pulling on the handle strap 38 to simultaneously unzip the double zipper means 36 to gain immediate access to the interior of the container 10 to remove the articles contained therein all while the container 10 is retained on the user's shoulder by means of strap 12.

It will further be appreciated that although the preferred embodiment of the present invention is for use retaining articles such as laptop computers, computer accessories, cameras, camera equipment and other like articles retained in the container, the present invention direct closure top including the side closure flaps 26 and double zipper means 36 in the top with the handle strap 38 to simultaneously unzip the top can be used with any type of bag, case or the like which retains any other type of article not disclosed herewith.

In addition, while the preferred embodiment is to have the handle strap 38 to simultaneously unzip the double zipper means 36, it is also within the spirit and scope of the present invention to have individual zipper tabs on each of the zipper means 36 so that each one can be individually opened.

In addition, while the preferred fastening means on the top is the double zipper member, it will be appreciated that other fastening means can be used in place of the double zipper member. For example, double hook and loop mating members can be used and simultaneously opened by a handle member when pulled upwardly on the top to open the top by separating the pair of male and female hook and loop members.

Defined in detail, the present invention is a container for facilitating rapid access to the interior of the container to remove articles from the container, comprising: (a) a generally rectangular body having a base, two end walls and two sidewalls respectively interconnected at their adjacent edges to adjacent edges of the two end walls, the walls extending upwardly from the base to form the body with a top opening; (b) a side closure flap attached to a respective one of the two sidewalls and secured against the respective one of the two sidewalls by fastener means, the side closure flap adapted to span over and covering the top opening of the body and forming a top when the side closure flap is in a closed position; and (c) the top of the side closure flap having full length double zipper means for opening or closing the top to gain access to the interior of the body; (d) whereby the interior of the body of the container is accessed by either flipping over the side closure flap to an open position or unzipping the double zipper means on the top of the body of the container to access the interior through the top opening of the body of the container.

Defined broadly, the present invention is a container for facilitating rapid access to the interior of the container to remove articles from the container, comprising: (a) a body having a base and a plurality of walls respectively interconnected at their adjacent edges and extending upwardly from the base to form the body with a top opening; (b) a side closure flap attached to a respective one of the plurality of walls and secured against another respective one of the plurality of walls by fastener means, the side closure flap adapted to span over and covering the top opening of the body and forming a top when the side closure flap is in a closed position; and (c) the top of the side closure flap having full length double zipper means for opening or closing the top to gain access to the interior of the body; (d) whereby the interior of the body of the container is accessed by either flipping over the side closure flap to an open position or unzipping the double zipper means on the top of the body to access the interior through the top opening of the body.

Defined more broadly, the present invention is a container for facilitating rapid access to the interior of the container to remove articles from the container, comprising: (a) a container having a base and at least four walls respectively connected at their adjacent edges and extending upwardly from the base to form the container with a top opening; (b) a closure flap attached to a respective one of the at least four walls and secured against another respective one of the at least four walls by fastener means, the closure flap adapted to span over and covering the top opening of the container and forming a top when the closure flap is in a closed position; and (c) the top of the closure flap having zipper means for opening or closing the top to gain access to the interior of the container; (d) whereby the interior of the container is accessed by either flipping over the closure flap to an open position or unzipping the zipper means on the top of the container to access the interior through the top opening of the container.

Defined even more broadly, the present invention is a bag for facilitating rapid access to the interior of the bag to remove articles therefrom, comprising: (a) a container having a base and a plurality of walls respectively interconnected at their adjacent edges and extending upwardly from the base to form the container with a top opening; (b) a side closure flap attached to a respective one of the plurality of walls and secured against another respective one of the plurality of walls by fastener means, the side closure flap adapted to span over and covering the top opening of the container and forming a top when the side closure flap is in a closed position; and (c) the top of the side closure flap having full length double zipper means for opening or closing the top to gain access to the interior of the container; (d) whereby the interior of the container is accessed by either flipping over the side closure flap to an open position or unzipping the double zipper means on the top of the container to access the interior through the top opening of the container.

Defined alternatively more broadly, the present invention is a bag for retaining articles, comprising: (a) a container having a base and a plurality of walls respectively connected at their adjacent edges and extending upwardly from the base to form the container with a top opening; (b) a closure flap attached to a respective one of the walls and secured against another of the respective one of the walls by fastener means, the closure flap adapted to span over and covering the top opening of the container and forming a top when the closure flap is in a closed position; and (c) the top of the closure flap having zipper means for opening or closing the top to gain access to the interior of the container; (d) whereby the interior of the container is accessed by either flipping over the closure flap to an open position or unzipping the zipper means on the top of the container to access the interior through the top opening of the container.

Further defined more broadly, the present invention is a bag for retaining articles, comprising: (a) a base and a multiplicity of walls respectively connected at their adjacent edges and extending upwardly from the base to form the bag with an opening; (b) a flap attached to a respective one of the walls and secured against another one of the respective walls by fastener means, the flap adapted to span over and covering the opening of the bag and forming a top when the flap is in a closed position; and (c) the top of the flap having fastening means for opening or closing the top to gain access to the interior of the bag; (d) whereby the interior of the bag is accessed by either flipping over the flap to an open position or opening the top of the bag to access to the interior through the opening of the bag.

Further defined even more broadly, the present invention is a bag for retaining articles, comprising: (a) a container having a base and a multiplicity of walls respectively connected at their edges and extending upwardly from the base to form the container with an opening; (b) the container having a top member attached to a wall portion of the container to cover the opening; and (c) the top member having fastening means for opening or closing the top member to gain access to the interior of the container; (d) whereby the interior of the container is accessed by opening the top member of the container through opening the fastening means to gain access to the interior of the container.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A container for facilitating rapid access to the interior of the container to remove articles from the container, comprising:

a. a generally rectangular body having a base, two end walls and two sidewalls respectively interconnected at their adjacent edges to adjacent edges of the two end walls, the walls extending upwardly from the base to form the body with a top opening;

b. a side closure flap attached to a respective one of said two sidewalls and secured against the respective one of said two sidewalls by fastener means, the side closure flap adapted to span over and covering said top opening of said body and forming a top when the side closure flap is in a closed position; and c. said top of said side closure flap having full length double zipper means for opening or closing said top to gain access to the interior of said body;

d. whereby the interior of said body of said container is accessed by either flipping over said side closure flap to an open position or unzipping said double zipper means on said top of said body to access the interior through said top opening of said body of said container.

2. The container in accordance with claim 1, further comprising a handle strap connected to said double zipper means for simultaneously pulling said double zipper means to the open position or the closed position.

3. The container in accordance with claim 1, further comprising fastener means for securing said top in a closed position.

4. The container in accordance with claim 3, wherein said fastener means includes a male type hook member and a complementary female loop type member.

5. The container in accordance with claim 1, further comprising a first hand tab attached at one end of said top and a second hand tab attached to a wall portion adjacent to the first hand tab.

6. The container in accordance with claim 1, further comprising an adjustable shoulder strap, where ends of the shoulder strap are respectively attached to said end walls of said body.

7. A container for facilitating rapid access to the interior of the container to remove articles from the container, comprising:

a. a body having a base and a plurality of walls respectively interconnected at their adjacent edges and extending upwardly from the base to form the body with a top opening;

b. a side closure flap attached to a respective one of said plurality of walls and secured against another respective one of said plurality of walls by fastener means, the side closure flap adapted to span over and covering said top opening of said body and forming a top when the side closure flap is in a closed position; and c. said top of said side closure flap having full length double zipper means for opening or closing said top to gain access to the interior of said body;

d. whereby the interior of said body of said container is accessed by either flipping over said side closure flap to an open position or unzipping said double zipper means on said top of said body to access the interior through said top opening of said body.

8. The container in accordance with claim 7, further comprising a handle strap connected to said double zipper means for simultaneously pulling said double zipper means to the open position or the closed position.

9. The container in accordance with claim 7, further comprising fastener means for securing said top in a closed position.

10. The container in accordance with claim 9, wherein said fastener means includes a male type hook member and a complementary female loop type member.

11. The container in accordance with claim 7, further comprising a first hand tab attached at one end of said top and a second hand tab attached to a wall portion adjacent to the first hand tab.

12. The container in accordance with claim 7, further comprising an adjustable shoulder strap, where ends of the shoulder strap are respectively attached to a respective two of said plurality of walls of said body and an adjustable shoulder pad slidably installed on the shoulder strap.

13. A container for facilitating rapid access to the interior of the container to remove articles from the container, comprising:

a. a container having a base and at least four walls respectively connected at their adjacent edges and extending upwardly from the base to form the container with a top opening;

b. a closure flap attached to a respective one of said at least four walls and secured against another respective one of said at least four walls by fastener means, the closure flap adapted to span over and covering said top opening of said container and forming a top when the closure flap is in a closed position; and c. said top of said closure flap having zipper means for opening or closing said top to gain access to the interior of said container;

d. whereby the interior of said container is accessed by either flipping over said closure flap to an open position or unzipping said zipper means on said top of said container to access the interior through said top opening of said container.

14. The container in accordance with claim 13, wherein said zipper means includes a full length double type zipper member.

15. The container in accordance with claim 14, further comprising a handle strap connected to said double zipper member for simultaneously pulling said double zipper member to the open position or the closed position.

16. The container in accordance with claim 13, further comprising fastener means for securing said top in a closed position.

17. The container in accordance with claim 16, wherein said fastener means includes a male type hook member and a complementary female loop type member.

18. The container in accordance with claim 13, further comprising a first hand tab attached at one end of said top and a second hand tab attached to a wall portion adjacent to the first hand tab.

19. The container in accordance with claim 13, further comprising an adjustable shoulder strap, where ends of the shoulder strap are respectively attached to a respective two of said at least four walls of said container and an adjustable shoulder pad slidably installed on said shoulder strap for adjustment in the lengthwise direction.

20. A bag for facilitating rapid access to the interior of the bag to remove articles therefrom, comprising:

a. a container having a base and a plurality of walls respectively interconnected at their adjacent edges and extending upwardly from the base to form the container with a top opening;

b. a side closure flap attached to a respective one of said plurality of walls and secured against another respective one of said plurality of walls by fastener means, the side closure flap adapted to span over and covering said top opening of said container and forming a top when the side closure flap is in a closed position; and c. said top of said side closure flap having full length double zipper means for opening or closing said top to gain access to the interior of said container;

d. whereby the interior of said container is accessed by either flipping over said side closure flap to an open position or unzipping said double zipper means on said top of said container to access the interior through said top opening of said container.

21. The bag in accordance with claim 20, further comprising a handle strap connected to said double zipper means for simultaneously pulling said double zipper means to the open position or the closed position.

22. The bag in accordance with claim 20, further comprising fastener means for securing said top in a closed position.

23. The bag in accordance with claim 22, wherein said fastener means includes a male type hook member and a complementary female loop type member.

24. The bag in accordance with claim 20, further comprising a first hand tab attached at one end of said top and a second hand tab attached to a wall portion adjacent to the first hand tab.

25. The bag in accordance with claim 20, further comprising an adjustable shoulder strap, where ends of the shoulder strap are respectively attached to a respective two of said plurality of walls of said container.

26. A bag for retaining articles, comprising:

a. a container having a base and a plurality of walls respectively connected at their adjacent edges and extending upwardly from the base to form the container with a top opening;

b. a closure flap attached to a respective one of said walls and secured against another of the respective one of said walls by fastener means, the closure flap adapted to span over and covering said top opening of said container and forming a top when the closure flap is in a closed position; and c. said top of said closure flap having zipper means for opening or closing said top to gain access to the interior of said container;

d. whereby the interior of said container is accessed by either flipping over said closure flap to an open position or unzipping said zipper means on said top of said container to access the interior through said top opening of said container.

27. The bag in accordance with claim 26, wherein said zipper means includes a full length double type zipper member.

28. The bag in accordance with claim 27, further comprising a handle strap connected to said double zipper member for simultaneously pulling said double zipper member to the open position or the closed position.

29. The bag in accordance with claim 26, further comprising fastener means for securing said top in a closed position.

30. The bag in accordance with claim 29, wherein said fastener means includes a male type hook member and a complementary female loop type member.

31. The bag in accordance with claim 26, further comprising an adjustable shoulder strap, where ends of the shoulder strap are respectively attached to a respective two of said walls of said container.

32. The bag in accordance with claim 31, further comprising an adjustable shoulder pad slidably installed on said shoulder strap for adjustment in the lengthwise direction.

33. A bag for retaining articles, comprising:

a. a base and a multiplicity of walls respectively connected at their adjacent edges and extending upwardly from the base to form the bag with an opening;

b. a flap attached to a respective one of said walls and secured against another one of the respective walls by fastener means, the flap adapted to span over and covering said opening of said bag and forming a top when the flap is in a closed position; and c. said top of said flap having fastening means for opening or closing said top to gain access to the interior of said bag;

d. whereby the interior of said bag is accessed by either flipping over said flap to an open position or opening said top of said bag to access to the interior through said opening of said bag.

34. The bag in accordance with claim 33, wherein said fastening means includes a full length double type zipper member.

35. The bag in accordance with claim 34, further comprising a handle strap connected to said double zipper member for simultaneously pulling said double zipper member to the open position or the closed position.

36. The bag in accordance with claim 33, further comprising fastener means for securing said top in a closed position.

37. The bag in accordance with claim 36, wherein said fastener means include a male type hook member and a complementary female loop type member.

38. The bag in accordance with claim 33, further comprising an adjustable shoulder strap, where ends of the shoulder strap are respectively attached to a respective two of said walls of said bag.

39. The bag in accordance with claim 38, further comprising an adjustable shoulder pad slidably installed on said shoulder strap for adjustment in the lengthwise direction.

* * * * *